US012024984B2

(12) United States Patent
Li et al.

(10) Patent No.: US 12,024,984 B2
(45) Date of Patent: Jul. 2, 2024

(54) SYSTEM AND METHOD FOR EXPLOITING NATURAL GAS HYDRATE WITH DOWNHOLE GAS-LIQUID SYNERGIC DEPRESSURIZATION

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Xuke Ruan, Guangzhou (CN); Zhaoyang Chen, Guangzhou (CN); Gang Li, Guangzhou (CN); Yu Zhang, Guangzhou (CN); Yi Wang, Guangzhou (CN); Kefeng Yan, Guangzhou (CN); Jiayuan Zhou, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 0 days.

(21) Appl. No.: 18/016,674

(22) PCT Filed: Oct. 24, 2022

(86) PCT No.: PCT/CN2022/126879

§ 371 (c)(1),
(2) Date: Jul. 6, 2023

(87) PCT Pub. No.: WO2023/124449

PCT Pub. Date: Jul. 6, 2023

(65) Prior Publication Data

US 2024/0183250 A1 Jun. 6, 2024

(30) Foreign Application Priority Data

Sep. 26, 2022 (CN) ..... 202211180387.4

(51) Int. Cl.
*E21B 41/00* (2006.01)
*E21B 43/38* (2006.01)

(52) U.S. Cl.
CPC ..... *E21B 41/0099* (2020.05); *E21B 43/385* (2013.01)

(58) Field of Classification Search
CPC ..... E21B 41/0099; E21B 43/01; E21B 47/06; E21B 49/00; E21B 43/02
See application file for complete search history.

(56) References Cited

PUBLICATIONS

English translation for CN 106837338 (Year: 2017).*
English translation for CN 106869871 (Year: 2019).*
English translation for CN 210919000 (Year: 2020).*

* cited by examiner

*Primary Examiner* — Zakiya W Bates
(74) *Attorney, Agent, or Firm* — Bayramoglu Law Offices LLC

(57) ABSTRACT

A system for exploiting natural gas hydrate with downhole gas-liquid synergic depressurization includes a casing configured to form an exploitation well. An upper end of the exploitation well is connected to a produced gas collection pipeline, and the produced gas collection pipeline is configured to be connected to a produced gas recovery system. A perforated channel is distributed in a section of the casing located in a natural gas hydrate reservoir. A tubular string component assembly is mounted in the exploitation well, and includes an outer string, a production tubular string and an auxiliary riser. A first check valve is mounted at the bottom of the outer string, a gas supply pipeline is connected into an upper portion of the outer string, and a flow controller is mounted in the gas supply pipeline. The production tubular string is mounted in the outer string.

15 Claims, 2 Drawing Sheets

SYSTEM AND METHOD FOR EXPLOITING NATURAL GAS HYDRATE WITH DOWNHOLE GAS-LIQUID SYNERGIC DEPRESSURIZATION

CROSS REFERENCE TO THE RELATED APPLICATIONS

This application is the national phase entry of International Application No. PCT/CN2022/126879, filed on Oct. 24, 2022, which is based upon and claims priority to Chinese Patent Application No. 202211180387.4, filed on Sep. 26, 2022, the entire contents of which are incorporated herein by reference.

TECHNICAL FIELD

The present invention relates to the field of natural gas hydrate exploitation, and in particular to a system and method for exploiting natural gas hydrate with downhole gas-liquid synergic depressurization.

BACKGROUND

Natural gas hydrate is regarded as the most potential new clean energy for replacing the traditional fossil energy in the 21st century. The natural gas hydrate has advantages such as huge reserves, wide distribution, high energy density and clean combustion, and thus is attracting more and more attention around the world. China has successfully drilled core samples of natural gas hydrate in a permafrost region of Qinghai Province on land and in the Shenhu area of the northern South China Sea, which proves that such clean energy is contained both on the land and in the sea area of China. With the continuously deepening investigation and analysis, six natural gas hydrate metallogenic prospect, with a total area being up to 148,400 $km^2$ and predicted prospective resources being equivalent to 74.4 billion tons of oil equivalent, have been divided in the sea area of the continental slope of the northern South China Sea. Further, the second trial exploitation of natural gas hydrate was successfully realized in the Shenhu area of the South China Sea at a water depth of 1,225 m in the year of 2020, which has achieved new world records for the exploitation of natural gas hydrate resources, such as "continuous gas production for 30 days, a total gas production amount of 861,400 $m^3$ and an average daily gas production amount of 28,700 $m^3$" (Ye Jianliang, Qin Xuwen, Xie Wenwei, et al. Main progress of the second trial exploitation of natural gas hydrate in the South China Sea. Geology in China, 2020, 47(3): 557-568). Therefore, the realization of hydrate development and utilization is of great strategic significance for China to cope with energy shortage and climate change, ensure energy safety and maintain sustainable development of society.

According to the experience of field trial exploitation of hydrate in the Mackenzie Delta of Canada, a permafrost zone on the north slope of Alaska in the US, the South Sea Trough of Japan and the Shenhu area of the South China Sea, a depressurization method and its improvement scheme are considered as the best way to achieve efficient exploitation of natural gas hydrate (Mao Peixiao, Wu Nengyou, Ning Fulong, et al. Laws of gas and water production of natural gas hydrate with depressurized-induced exploitation under different well types. Natural Gas Industry, 2020, 40(11): 168-176). However, it is also to be noted that, different from the conventional exploitation of the traditional fossil energy such as coal, oil and natural gas, the exploitation of natural gas hydrate includes three-phase (solid, liquid and gas) substances, and the exploitation process further includes phase change decomposition/reformation of hydrate. Since the phase change process is coupled with a fluid-solid-heat multi-physical field, the in-situ exploitation of natural gas hydrate is more complex than the traditional oil and gas exploitation. During the simple depressurization-induced exploitation of natural gas hydrate, solid natural gas hydrate decomposes into gaseous natural gas and liquid-phase water by depressurization, and a cementing skeleton of sediment particles in the reservoir is weakened, resulting in the strength reduction of the hydrate reservoir (or even deformation of the reservoir) and sand production on the formation. The decomposed gas and water as well as moving sediment particles also reduce the porosity of the reservoir and decrease the permeability of the hydrate reservoir, thereby slowing down the decomposition of natural gas hydrate and lowering the efficiency of gas production. In the case of long-term exploitation, the decomposition of hydrate and the production of gas and water will deplete the reservoir, further lead to the instability of the formation, and affect the stability of an tubular string of exploitation well, and the like, thereby severely damaging the undersea environment.

In addition, there is always a large amount of water (hydrate of 1 $m^3$ may decompose and produce water of 0.8 $m^3$) during hydrate exploitation. Studies have shown that the flow of water promotes hydrate decomposition (Yang Mingjun, Sun Huiru, Chen Bingbing, et al. Study on enhancing natural gas hydrate depressurization and decomposition by water flow. Journal of Engineering Thermophysics, 2020, 41(2): 307-312), and the reasonable treatment of a large amount of water produced by hydrate decomposition is a practical problem to be faced during the hydrate exploitation. However, there are still few relevant efforts and explorations on the combination of water treatment and depressurization, and it is necessary to further develop and innovate the hydrate exploitation method.

In summary, it is urgently needed to propose an exploitation scheme that can satisfy the treatment of a large amount of water produced by hydrate decomposition and prevent the large-area depletion and instability of the reservoir during exploitation of the produced gas and water in combination with the most economical natural gas hydrate depressurization method with the best industrial prospect, so as to realize the economy, safety and high efficiency of long-term exploitation of natural gas hydrate.

SUMMARY

In order to overcome the above shortcomings in the prior art, an object of the present invention is to provide a system and method for exploiting natural gas hydrate with downhole gas-liquid synergic depressurization, so as to realize the comprehensive utilization and treatment of liquid-phase water produced by decomposition of a large amount of downhole hydrate, solve the problems of control of depletion and instability of the reservoir in a process of producing gas and water through hydrate decomposition, and finally achieve the object of safe and continuous depressurization-induced exploitation of the natural gas hydrate.

In order to achieve the above object, the present invention adopts the following technical solutions.

In a first aspect of the present invention, there is provided a system for exploiting natural gas hydrate with downhole gas-liquid synergie depressurization. The system includes:

A casing configured to penetrate through a marine layer, an upper sediment covering layer, a natural gas hydrate reservoir and a lower sediment covering layer so as to form an exploitation well, wherein an upper end of the exploitation well is connected to a produced gas collection pipeline, and the produced gas collection pipeline is configured to be connected to a produced gas recovery system; a perforated channel is distributed in a section of the casing located in the natural gas hydrate reservoir; and a filtering device is arranged around the section of the casing located in the natural gas hydrate reservoir; and A tubular string component assembly is mounted in the exploitation well, and includes an outer string, a production tubular string and an auxiliary riser; a first check valve is mounted at the bottom of the outer string, a gas supply pipeline is connected into an upper portion of the outer string, and a flow controller is mounted in the gas supply pipeline to regulate the flow rate of gas entering the outer string; the production tubular string is mounted in the outer string, a space between the outer string and the production tubular string serves as a water storage chamber, and a second check valve is mounted at the bottom of the production tubular string; and the auxiliary riser is mounted in the production tubular string to discharge liquid-phase water.

Further, the system for exploiting natural gas hydrate with downhole gas-liquid synergic depressurization includes a monitoring well that is independent of the exploitation well and configured to monitor a pressure change of the natural gas hydrate reservoir.

Further, a top end of the auxiliary riser is connected to a gas-water separation device, and the gas-water separation device is configured to separate natural gas and water in the liquid-phase water; the gas-water separation device is also connected to a water outlet pipeline to convey the separated water to the water outlet pipeline. The water outlet pipeline is connected to a water return pipeline, a switch valve is mounted in the water return pipeline, and part of the outlet water enters the water return pipeline through the switch valve when necessary, is heated by a heating device, and then returned to the outer string.

Further, the gas-water separation device is connected to the produced gas collection pipeline to convey the separated natural gas to the produced gas collection pipeline.

Further, a circulating valve is mounted in a pipeline connected to the gas-water separation device and the produced gas collection pipeline; and a gas flow detector is mounted in the produced gas collection pipeline.

Further, the filtering device is gravel; and a gravel settlement pit is arranged in the lower sediment covering layer through which the casing penetrates.

Further, a sand filtering device is arranged in the gravel settlement pit.

In a second aspect of the present invention, there is a method for exploiting natural gas hydrate with downhole gas-liquid synergic depressurization based on the above system. The method includes the following steps.

In step 1, a production casing penetrating through a marine layer, an upper sediment covering layer, a natural gas hydrate reservoir and a lower sediment covering layer is formed on a formation of a metallogenic region of natural gas hydrate to perform a well cementing operation; a drilling operation is performed and the perforated channels are arranged in a casing section of the natural gas hydrate reservoir, and gravel is packed around a wall of the casing in the natural gas hydrate reservoir; a gravel settlement pit is arranged in the lower sediment covering layer through which the casing penetrates; and a monitoring well is correspondingly arranged in the vicinity of a hydrate exploitation well to monitor a pressure change of the natural gas hydrate reservoir in real-time.

In step 2, a tubular string component assembly is dropped and mounted in a borehole of the exploitation well formed by the casing to carry out depressurized production according to the pressure of the natural gas hydrate reservoir, gas and water production behavior of hydrate pressurization-induced decomposition, and pressure conditions of gas and water in the exploitation well.

In step 3, the gas produced from hydrate depressurization-induced decomposition in the natural gas reservoir is recovered through a produced gas collection pipeline at an upper end of the casing exploitation well; and the produced water is regulated and controlled step by step according to the overall requirements of hydrate depressurized production, and then discharged to the outside through the casing exploitation well, a water storage chamber, an annular region in a production tubular string and an auxiliary riser, and finally separated by a gas-water separation device of an operation platform for recovery.

Further, said step 2 includes:

Opening an outlet end of a produced gas recovery system and a pipeline thereof to collect the produced gas so as to realize gas extraction and depressurization of the hydrate reservoir, and then, filtering out particle sediments in the gas and water produced by decomposition of natural gas hydrate through a gravel packing region of the casing to enable the gas and water to flow into the exploitation well through the perforated channels for primary natural separation of gas and water, such that the gas is gradually gathered in an upper portion of the casing exploitation well, and correspondingly, the liquid-phase water is slowly gathered at the bottom of the exploitation well, wherein the liquid-phase water entering the casing exploitation well is always kept at or above a safe water level in the above process; and The produced gas gathered in the upper portion of the casing exploitation well flows to the outlet end through the produced gas collection pipeline connected to the exploitation well for measurement, collection and utilization according to the gas and water production condition of hydrate decomposition and the pressure change condition in the natural gas hydrate reservoir, and a first check valve at the bottom of the outer string and a second check valve at the bottom of the production tubular string are opened at proper time to regulate and control the liquid-phase water above the safe water level in the exploitation well step by step and discharge the liquid-phase water under the condition of satisfying safe and effective depressurized production, so as to form an downhole gas-liquid synergic depressurized exploitation operation among the natural gas hydrate reservoir, the casing exploitation well, the water storage chamber and the annular region in the production tubular string.

Further, in said step 3, the discharged produced gas is measured by a gas flow detector, and then enters a gas storage, or is stored through liquification, wherein a part of the gas enters the water storage chamber through a gas supply pipeline and a flow controller for pressurization and water discharge when there is a pressure compensation requirement for the water storage chamber; and the produced water discharged from the water storage chamber passes the gas-water separation device, one part of the water enters a water outlet pipeline for collection, and the other part of the water enters a water return pipeline, and is then heated by a heating device and returned to the water storage chamber.

Compared to the prior art, the present invention has the following beneficial effects.

The present invention is characterized in that the depressurization-induced exploitation of natural gas hydrate resources is performed with a synergistic effect of downhole gas-liquid discharge, such that a scheme for treating the water produced by decomposition of natural gas hydrate is provided while avoiding the violent pressure fluctuation of the reservoir during exploitation, preventing the large-area depletion of the reservoir and maintaining the stability of the reservoir. Specifically, the present invention has the following advantages. In the technical solution of exploiting natural gas hydrate with downhole gas-liquid synergic depressurization according to the present invention, a conventional electric submersible pump for downhole water and gas pumping is omitted, thereby saving equipment costs and corresponding operation and maintenance costs. In the technical solution of exploiting natural gas hydrate with downhole gas-liquid synergic depressurization according to the present invention, the water to be discharged is regulated and controlled step by step in cooperation with gas-discharge synergic depressurization while ensuring the safety and stability of the reservoir during depressurization-induced exploitation, thereby promoting the effective flow of gas and liquid during hydrate exploitation, improving the decomposition efficiency and productivity of the hydrate, and effectively prolonging a depressurized exploitation period. The technical solution of exploiting natural gas hydrate with downhole gas-liquid synergic depressurization according to the present invention may comprehensively solve the problem of treatment of a large amount of water produced during the exploitation of natural gas hydrate. In the present invention, the problem of generation of sediments in large and small particles is prevented and solved step by step by packing gravel around the casing wall in the hydrate reservoir and arranging the settlement pit in the lower sediment covering layer through which the casing penetrates, thereby satisfying and being applicable to the sand control treatment in the process of exploiting natural gas hydrate with downhole gas-liquid synergic depressurization according to the present invention and effectively preventing sediments and gravel from entering the production tubular string. In the present invention, the water produced in the reservoir is recovered, heated and reused, and then, the hot water flows back to the outer string, effectively preventing the secondary generation of the hydrate in a production wellbore, and the like.

In summary, the solution of the present invention is easy to realize with mature related application equipment technology, can rapidly realize the industrial exploitation and application of natural gas hydrate, and thus is an innovative, safe, economical and effective hydrate exploitation method.

Figure 1:
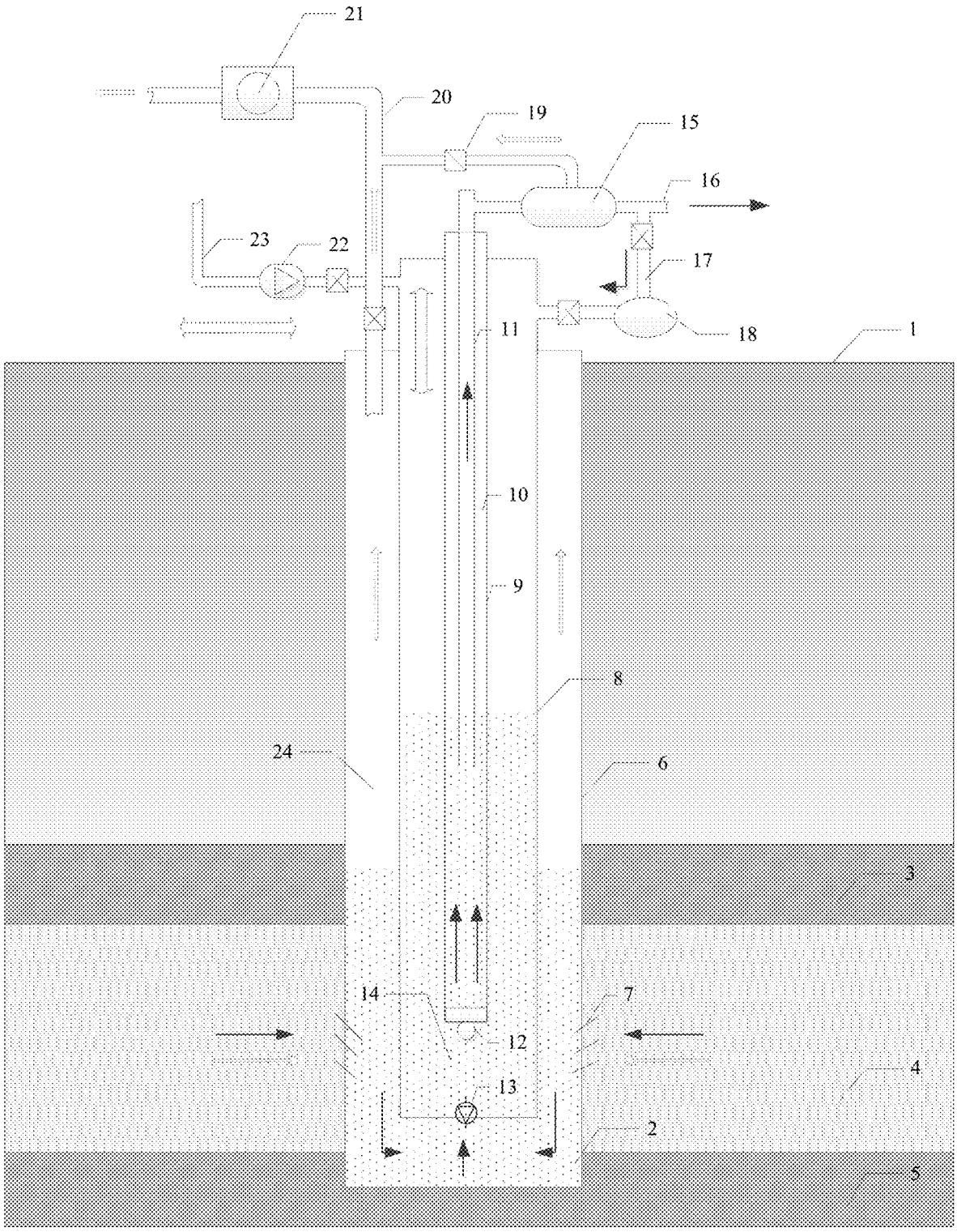
FIG. 1 is a schematic diagram of a system for exploiting natural gas hydrate with downhole gas-liquid synergic depressurization according to an embodiment of the present invention.

In the drawings, 1, marine layer; 2, gravel settlement pit; 3, upper covering layer, 4, natural gas hydrate reservoir; 5, lower covering layer; 6, casing; 7, perforated channel; 8, outer string; 9, production tubular string; 10, annular region; 11, auxiliary riser; 12, second check valve; 13, first check valve; 14, water storage chamber; 15, gas-water separation device; 16, water outlet pipeline; 17, water return pipeline; 18, heating device; 19, circulating valve; 20, produced gas collection pipeline; 21, gas flow detector; 22, flow controller; 23, gas supply pipeline; and 24, exploitation well.

DETAILED DESCRIPTION OF THE EMBODIMENTS

In the description of the present invention, it is to be noted that, unless otherwise clearly prescribed and defined, the terms "mounted" and "connected" should be understood in a broad sense, and may be, for example, fixed connection or detachable connection, or integral connection; mechanical connection or direct connection, or indirect connection through an intermediate medium; or internal communication of two elements. For those of ordinary skills in the art, the specific meaning of the above terms in the present invention may be understood in specific situations. The technical solution of the present invention will be further described below with reference to the accompanying drawings and embodiments.

Embodiment 1

Referring to FIG. 1, when the system for exploiting natural gas hydrate with downhole gas-liquid synergic depressurization according to this embodiment is applied, firstly, a casing 6 penetrating through a marine layer 1, an upper sediment covering layer 3, a natural gas hydrate reservoir 4 and a lower sediment covering layer 5 is formed on a formation of a metallogenic region of natural gas hydrate to perform a well cementing operation and form an exploitation well 24. An upper end of the exploitation well 24 is connected to a produced gas collection pipeline 20, and the produced gas pipeline 20 is configured to be connected to a produced gas recovery system to collect natural gas. Then, a drilling operation is performed and a perforated channel 7 is arranged in a casing section of the natural gas hydrate reservoir 4, and gravel is packed around a wall of the casing section of the natural gas hydrate reservoir to filter out large-particle sediments and prevent the large-particle sediments from entering the casing 6. In addition, a gravel settlement pit 2 may also be arranged in the lower sediment covering layer 5 through which the casing penetrates.

A tubular string component assembly relating to gas-liquid synergic depressurization is dropped and mounted in a borehole of the exploitation well 24 formed by the casing 6, and the tubular string assembly includes an outer string 8, a production tubular string 9 and an auxiliary riser 11; a first check valve 13 is mounted at the bottom of the outer string 8, and is required to have a certain sand control function; a gas supply pipeline 23 is connected into an upper portion of the outer string 8, and a flow controller 22 is mounted in the gas supply pipeline 23 to regulate the flow rate of gas entering the outer string 8; the upper portion of the outer string 8 is also connected to a water return pipeline 17 to heat part of the returned water and return the heated water to the outer string 8 (for regulating and compensating a hydrostatic pressure in the outer string and preventing the secondary generation of hydrate); the production tubular string 9 is mounted in the outer string 8, a space between the outer string 8 and the production tubular string 9 serves as a water storage chamber 1; a second check valve 12 is mounted at the bottom of the production tubular string 9; and the auxiliary riser 11 is mounted in the production tubular string 9, and a gap therebetween serves as an annular region 10 to discharge liquid-phase water.

As a preferred embodiment of the system in the present invention, a monitoring well is correspondingly arranged in the vicinity of the exploitation well 24 to monitor a pressure change of the natural gas hydrate reservoir 4 in real time. Pressure data of the natural gas hydrate reservoir is used to determine the stability of the natural gas hydrate reservoir 4 and regulate and control the subsequent water discharge away from the natural gas hydrate reservoir and the depressurization and decomposition process of the hydrate.

As another preferred embodiment of the system in the present invention, a top end of the auxiliary riser 11 is connected to a gas-water separation device 15, and the gas-water separation device 15 is configured to separate natural gas and water in the liquid-phase water; the gas-water separation device 15 is also connected to a water outlet pipeline 16 to output the separated water, the water outlet pipeline 16 is connected to the water return pipeline 17, a switch valve is mounted in the water return pipeline 17, and part of the outlet water enters the water return pipeline 17 through the switch valve when necessary, is heated by a heating device 18, and then returned to the outer string 8. In addition, the gas-water separation device 15 is also connected to the produced gas collection pipeline 20 to convey the separated natural gas to the produced gas collection pipeline 20, and a circulating valve 19 is mounted in a pipeline connecting the gas-water separation device 15 and the produced gas collection pipeline 20; and a gas flow detector 21 is mounted in the produced gas collection pipeline 20 to count the amount of the collected natural gas.

After the relevant well is arranged and the downhole equipment is mounted as described above, an outlet end of the produced gas collection pipeline 20 of the gas and water recovery system and the circulating valve 19 on the pipeline thereof are opened. In this way, the pressure of the natural gas hydrate reservoir 4 communicated with the gas and water recovery system through the exploitation well will be reduced, and the natural gas hydrate in the natural gas hydrate reservoir 4 begins to decompose due to the destruction of phase equilibrium, and the gas and water produced by decomposition flow into the exploitation well 24 along the perforated channel 7. The gas and water flowing into the exploitation well 24 firstly pass a gravel packing region of the casing to filter out large-particle sediments that may be carried in the gas and water and produced from the natural gas hydrate reservoir 4. The filtered gas and water flow into the exploitation well 24 for primary natural separation of gas and water, such that the gas is gradually gathered in the upper portion inside the exploitation well 24, and correspondingly, the liquid-phase water is slowly gathered at a lower end of the exploitation well 24. At the same time, small-particle sediments flowing out of the natural gas hydrate reservoir along with the gas and water are naturally settled in the gravel settlement pit 2, and a sand filtering device may also be arranged and started in the gravel settlement pit 2 when necessary, for rapidly and greatly filtering out the small-particle sediments. In the above process, the water level of the liquid-phase water entering the exploitation well 24 is always kept at or above a certain safe value to prevent the dramatic change of the pressure between the exploitation well and the hydrate reservoir and to avoid the instability of the hydrate reservoir caused by large-area depletion due to the outflow of gas and water.

According to the output condition of gas and water produced by hydrate decomposition and the pressure change condition in the natural gas hydrate reservoir, the first check valve 13 at the bottom of the outer string 8 is opened at the proper time, such that the liquid-phase water exceeding the water level requirement in the exploitation well 24 enters the water storage chamber 14 through the first check valve 13 having a sand control function due to the effect of pressure difference. Such a process of discharging the water from the exploitation well 24 to the water storage chamber 14, the same as collecting the produced gas by opening the produced gas collection pipeline 20, will decrease the pressure in the exploitation well 24 and the pressure in the natural gas hydrate reservoir 4 to some extent, thereby continuously forming an effective driving force for hydrate depressurization and decomposition, promoting the decomposition, and further facilitating the flow of gas and water in the natural gas hydrate reservoir 4.

The closing of the first check valve 13 is determined according to the sand control capability and pressure conditions in the exploitation well 24 and the water storage chamber 14. Generally, when the sand control capability is not weakened and the pressures in the exploitation well 24 and the water storage chamber 14 can be dynamically kept stable, the first check valve 13 may always be in an open state. In the above process, the pressure in the outer string 8 is jointly determined by a gas pressure in the upper portion and the hydrostatic pressure in the water storage chamber 14. When the water storage chamber 14 is in a water storage state, the gas supply pipeline 23 and the flow controller 22 which are connected to the upper portion of the outer string 8 regulate the gas pressure in the upper portion of the water storage chamber 14 in the outer string 8 by regulating and controlling the gas flowing in or out of the outer string 8, such that the water storage chamber 14 may receive the produced water discharged from the exploitation well 24 continuously and smoothly from the first check valve 13. When the water level in the water storage chamber 14 rises to a certain value, the second check valve 12 at the bottom of the production tubular string 9 is started according to the overall prevention and control requirements, such that the water in the water storage chamber 14 enters the annular region 10 in the production tubular string 9. In this process, the gas supply pipeline 23 and the flow controller 22 may regulate the flow rate of the gas entering the outer string 8 to increase the gas pressure in the upper portion of the water storage chamber 14; and therefore, the produced water in the water storage chamber 14 can be smoothly discharged to the production tubular string 9 through the second check valve 12 at the bottom of the production tubular string 9 to regulate and control the water amount in the water storage chamber 14. The produced water entering the production tubular string 9 is finally discharged to the outside through the auxiliary riser 11 by the capillary siphon effect.

By opening the circulating valve 19, the gas separated from the gas-water separation device 15 flows into the produced gas collection pipeline 20, and enters the gas flow detector 21 together with the produced gas naturally separated from the exploitation well 24 through the produced gas collection pipeline 20 for measurement and collection.

Figure 2:
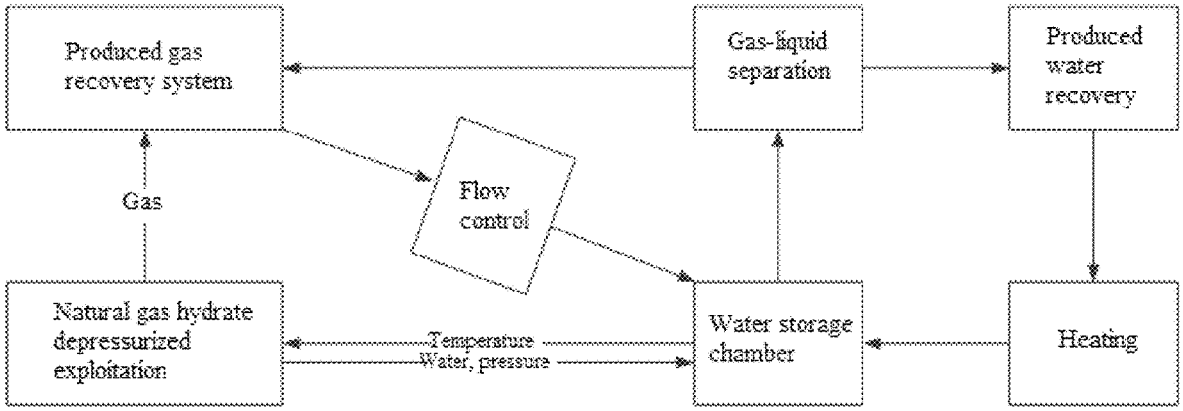
FIG. 2 is a flowchart of exploiting natural gas hydrate with downhole gas-liquid synergic depressurization.

Referring to FIG. 2, downhole gas-liquid synergic depressurization and safety control of the present invention are further described below.

After a return channel of the relevant pipeline of the produced gas recovery system is opened, a process of exploiting natural gas hydrate in the natural gas hydrate reservoir communicated with the produced gas recovery system through the exploitation well with depressurization and decomposition is started in the case of breaking pressure equilibrium under stable conditions. After the natural gas hydrate starts to decompose by depressurization, the gas and water produced by hydrate decomposition will dramatically increase the pressure in the natural gas hydrate reservoir. Under the action of the pressure difference among the natural gas hydrate reservoir, the exploitation well and the produced gas recovery end, the gas and water in the natural gas hydrate reservoir will gradually flow to the exploitation well end. The gas and water flowing into the exploitation well are naturally separated due to their different densities, such that the produced gas is gradually gathered in the upper portion of the exploitation well due to the small density, and the produced water is slowly accumulated in the lower portion of the exploitation well due to the relatively large density. When the produced water of the exploitation well is kept at a certain water level (the safe water level), a corresponding pressure is maintained in a portion of which the lower portion of the exploitation well is communicated with the natural gas hydrate reservoir. Therefore, the pressure between the exploitation well and the hydrate reservoir will not be changed too violently to destroy the reservoir, the gas and water can flow normally and smoothly without hinderance, and the outflow of a large amount of gas and water will not cause large-area depletion and further result in the instability of the hydrate reservoir, and the continuous decomposition of the hydrate will not be affected. In the above process, the monitoring well performs real-time detection and data collection for the pressure change in the reservoir, and thus determines the stability of the reservoir and regulates and controls a water-discharge synergic depressurization operation.

When the water amount in the exploitation well exceeds the safe water level, the water storage chamber is started to perform a graded water discharge operation for the water produced in the exploitation well, so as to promote the water produced in the exploitation well to enter the water storage chamber through the first check valve 13 under the drive of the pressure difference by utilizing a low-pressure environment of the water storage chamber. The water amount in the exploitation well is regulated to reduce the water level and the hydrostatic pressure in the exploitation well, so as to realize the water-discharge synergic depressurization on the basis of gas extraction and depressurization resulted from the recovery of the gas produced in the upper portion of the exploitation well. As the water produced in the exploitation well flows continuously, the water level in the water storage chamber rises continuously, and the pressure of the water storage chamber increases gradually. Then, according to the overall hydrate depressurized production and safety control conditions, by utilizing a high-pressure environment of the water storage chamber at the proper time, the produced water in the water storage chamber is discharged to the production tubular string, and finally discharged to the outside with the assistance of the auxiliary riser in the production tubular string under the action of the siphon. Meanwhile, the next graded water-discharge synergic depressurization process is started. In the above process, the low-pressure/high-pressure environment of the water storage chamber is regulated with the assistance of the flow controller controlling the inlet and outlet of gas, and this part of the gas source comes from the produced gas recovery system.

In addition, the water which is discharged from the water storage chamber and produced by hydrate decomposition is recovered after gas-water separation treatment, wherein a part of the water is heated by the heating device and the hot water is returned to the water storage chamber to prevent the secondary reformation of the hydrate in the wellbore string and eliminate a risk of blockage.

Embodiment 2

This embodiment provides a method for exploiting natural gas hydrate with downhole gas-liquid synergic depressurization based on the system of embodiment 1. Specifically, the method includes the following steps.

In step 1, the exploitation well and the relevant exploitation equipment thereof are arranged as follows: a production casing penetrating through a marine layer, an upper sediment covering layer, a natural gas hydrate reservoir and a lower sediment covering layer is formed on a formation of a metallogenic region of natural gas hydrate to perform a well cementing operation; a drilling operation is performed and the perforated channels are arranged in a casing section of the natural gas hydrate reservoir, and gravel is packed around a wall of the production casing in the natural gas hydrate reservoir; a gravel settlement pit is arranged in the lower sediment covering layer through which the casing penetrates, and a sand filtering device may also be arranged in the gravel settlement pit when necessary; and a monitoring well is correspondingly arranged in the vicinity of the hydrate exploitation well to monitor a pressure change of the natural gas hydrate reservoir in real-time.

In step 2, a tubular string component assembly relating to gas-liquid synergic depressurization is dropped and mounted in a borehole of the exploitation well formed by the production casing to carry out depressurized production according to the pressure of the reservoir, gas and water production behavior of hydrate decomposition, and pressure conditions of gas and water in the exploitation well.

In step 3, the gas produced from hydrate depressurization and decomposition in the natural gas reservoir is recovered through a produced gas collection pipeline at an upper end of the casing exploitation well; and the produced water is regulated and controlled step by step according to the overall requirements of hydrate depressurized production, and then discharged to an offshore operation platform through the casing exploitation well, a water storage chamber, a production tubular string component and an auxiliary riser, and finally recovered after passing a gas-water separation device.

Further, said step 2 specifically includes the followings.

After an outlet end of the produced gas collection pipeline of the gas and water recovery system is opened, the pressure of the hydrate reservoir communicated with the gas and water recovery system through the exploitation well will be reduced, the natural gas hydrate in the hydrate reservoir starts to decompose due to the destruction of phase equilibrium, and the gas and water produced by decomposition flow into the exploitation well along the perforated channels of the casing section of the hydrate reservoir, and are then filtered in the gravel packing region of the casing to filter out large-particle sediments that may be carried therein. The filtered gas and water flow into the casing exploitation well for primary natural separation of gas and water, such that the gas is gradually gathered in the upper portion of the casing exploitation well, and correspondingly, the liquid-phase water is slowly gathered at the bottom of the exploitation well. Meanwhile, small-particle sediments flowing out of the hydrate reservoir along with gas and water are naturally settled in the gravel settlement pit in the lower sediment covering layer through which the casing penetrates, and a sand filtering device may also be arranged and started in the gravel settlement pit when necessary, for rapidly and greatly filtering the small-particle sediments. In the above process, the water level of the liquid-phase water entering the casing exploitation well is always kept at or above a certain safe value to prevent the dramatic change of the pressure between the exploitation well and the hydrate reservoir and avoid the instability of the hydrate reservoir due to large-area depletion.

As the hydrate continues to decompose, the gas and water produced by decomposition in the hydrate reservoir continuously flow into the casing exploitation well, the produced gas gathered in the upper portion of the casing exploitation well flows to the outlet end through the produced gas collection pipeline connected to the exploitation well for collection and utilization, wherein the gas production speed/flow rate of the outlet end is determined according to pressure control requirements in the exploitation well and production economy. On the basis of ensuring a certain water level, the produced water gathered in the lower portion of the casing exploitation well flows into the water storage chamber through the check valve at the bottom of the outer string under the synergic action of the pressure in the reservoir, the pressure in the casing exploitation well and the pressure in the water storage chamber, wherein the check valve used herein is required to have a certain sand control function to prevent greatly small-particle sediments suspended in the liquid-phase water from entering the water storage chamber. As the liquid-phase water in the casing exploitation well flows into the water storage chamber, the pressure in the exploitation well will be further reduced to promote the flow of gas-liquid fluid in the reservoir, and facilitate the further depressurization and decomposition of the hydrate. Correspondingly, the water amount/water level in the water storage chamber will increase gradually. The water amount in the water storage chamber is controlled and arranged according to the overall progress of hydrate depressurization and the depressurization requirements. The water storage chamber may be inflated and pressurized through a gas supply return line at a top end of the water storage chamber, such that the liquid-phase water in the water storage chamber flows into the production tubular string through the check valve at the bottom of the production tubular string, and then discharged through the auxiliary riser, thereby forming an downhole gas-liquid synergic (gas and water discharge) depressurization system among the hydrate-bearing reservoir, the casing of exploitation well, the water storage chamber and the production tubular string component.

Further, said step 3 specifically includes the followings.

The discharged produced gas is measured by a gas flow detector, and then enters a gas storage, or is stored through liquification, wherein a part of the gas enters the downhole water storage chamber through a gas supply pipeline via a flow (pressure) control device for pressurization and water discharge when there is a pressure compensation requirement for the downhole water storage chamber. The produced water discharged from the downhole flows through the gas-water separation device of the offshore operation platform, one part of the water enters a water outlet pipeline for collection, and the other part of the water enters a water return pipeline, and is then heated by a heating device and returned to the downhole water storage chamber according to safety production requirements. The safety production requirements herein include safe pressure control in the reservoir and prevention of secondary generation of hydrate in the wellbore.

The aforesaid embodiments are only to illustrate the technical concept and features of the present invention, and are intended to enable those of ordinary skills in the art to understand the content of the present invention and to implement the present invention accordingly, but not intended to limit the protection scope of the present invention. Any equivalent changes or modifications made according to the essence of the content of the present invention shall be included in the protection scope of the present invention.

What is claimed is:

1. A system for exploiting natural gas hydrate with downhole gas-liquid synergic depressurization, comprising: a casing, wherein the casing is configured to penetrate through a marine layer, an upper sediment covering layer, a natural gas hydrate reservoir and a lower sediment covering layer to form an exploitation well, wherein an upper end of the exploitation well is connected to a produced gas collection pipeline, and the produced gas collection pipeline is configured to be connected to a produced gas recovery system; a perforated channel is distributed in a section of the casing, wherein the section of the casing is located in the natural gas hydrate reservoir; and a filtering device is arranged around the section of the casing; and a tubular string component assembly is mounted in the exploitation well, and the tubular string component assembly comprises an outer string, a production tubular string and an auxiliary riser; a first check valve is mounted at a bottom of the outer string, a gas supply pipeline is connected into an upper portion of the outer string, and a flow controller is mounted in the gas supply pipeline to regulate a flow rate of gas entering the outer string; the production tubular string is mounted in the outer string, a space between the outer string and the production tubular string serves as a water storage chamber, and a second check valve is mounted at a bottom of the production tubular string; and the auxiliary riser is mounted in the production tubular string to discharge liquid-phase water.

2. The system according to claim 1, further comprising a monitoring well, wherein the monitoring well is independent of the exploitation well, and the monitoring well is configured to monitor a pressure change of the natural gas hydrate reservoir.

3. The system according to claim 2, wherein a top end of the auxiliary riser is connected to a gas-water separation device, and the gas-water separation device is configured to separate natural gas and water in the liquid-phase water to obtain a separated natural gas and a separated water; the gas-water separation device is also connected to a water outlet pipeline to convey the separated water to the water outlet pipeline, the water outlet pipeline is connected to a water return pipeline, a switch valve is mounted in the water return pipeline, and a part of outlet water enters the water return pipeline through the switch valve when the part of the outlet water is necessary, is heated by a heating device, and then returned to the outer string.

4. The system according to claim 3, wherein the gas-water separation device is connected to the produced gas collection pipeline to convey the separated natural gas to the produced gas collection pipeline.

5. The system according to claim 4, wherein a circulating valve is mounted in a pipeline connecting the gas-water separation device and the produced gas collection pipeline; and a gas flow detector is mounted in the produced gas collection pipeline.

6. The system according to claim 3, wherein the filtering device is gravel; and a gravel settlement pit is arranged in the lower sediment covering layer through which the casing penetrates.

7. The system according to claim 6, wherein a sand filtering device is arranged in the gravel settlement pit.

8. The system according to claim 1, wherein a top end of the auxiliary riser is connected to a gas-water separation device, and the gas-water separation device is configured to separate natural gas and water in the liquid-phase water to obtain a separated natural gas and a separated water; the gas-water separation device is also connected to a water outlet pipeline to convey the separated water to the water outlet pipeline, the water outlet pipeline is connected to a water return pipeline, a switch valve is mounted in the water return pipeline, and a part of outlet water enters the water return pipeline through the switch valve when the part of the outlet water is necessary, is heated by a heating device, and then returned to the outer string.

9. The system according to claim 8, wherein the gas-water separation device is connected to the produced gas collection pipeline to convey the separated natural gas to the produced gas collection pipeline.

10. The system according to claim 9, wherein a circulating valve is mounted in a pipeline connecting the gas-water separation device and the produced gas collection pipeline; and a gas flow detector is mounted in the produced gas collection pipeline.

11. The system according to claim 8, wherein the filtering device is gravel; and a gravel settlement pit is arranged in the lower sediment covering layer through which the casing penetrates.

12. The system according to claim 11, wherein a sand filtering device is arranged in the gravel settlement pit.

13. A method for exploiting natural gas hydrate with downhole gas-liquid synergic depressurization based on the system according to claim 11, comprising the following steps:

in step 1, forming the casing penetrating through the marine layer, the upper sediment covering layer, the natural gas hydrate reservoir and the lower sediment covering layer on a formation of a metallogenic region of the natural gas hydrate to perform a well cementing operation; performing a drilling operation and arranging the perforated channel in a casing section in the natural gas hydrate reservoir, and packing gravel around a wall of the casing in the natural gas hydrate reservoir; arranging the gravel settlement pit in the lower sediment covering layer through which the casing penetrates; and correspondingly arranging a monitoring well in a vicinity of a hydrate exploitation well to monitor a pressure change of the natural gas hydrate reservoir in real time;

in step 2, dropping and mounting the tubular string component assembly in a borehole of the exploitation well formed by the casing to carry out depressurized production according to a pressure of the natural gas hydrate reservoir, gas and water production behavior of hydrate decomposition, and pressure conditions of gas and water in the exploitation well; and in step 3, recovering a gas produced from hydrate depressurization and decomposition in the natural gas hydrate reservoir through the produced gas collection pipeline at the upper end of the exploitation well; and regulating and controlling a produced water step by step according to overall requirements of hydrate depressurized production, and then discharging the produced water to an outside through the easing-exploitation well, the water storage chamber, an annular region in the production tubular string and the auxiliary riser, and finally separating the produced water by the gas-water separation device of an operation platform for recovery.

14. The method according to claim 13, wherein step 2 comprises:

opening an outlet end of the produced gas recovery system and a pipeline of the produced gas recovery system_to collect the produced gas to realize gas extraction and depressurization of the natural gas hydrate reservoir, and then, filtering out particle sediments in gas and water produced by decomposition of natural gas hydrate through a gravel packing region of the casing to allow the gas and water to flow into the exploitation well through the perforated channel for primary natural separation of gas and water, such that the gas is gradually gathered in an upper portion of the exploitation well, and correspondingly, the liquid-phase water is slowly gathered at a bottom of the exploitation well, wherein the liquid-phase water entering the exploitation well is always kept at or above a safe water level in the above process; and the produced gas gathered in the upper portion of the exploitation well flows to the outlet end through the produced gas collection pipeline connected to the exploitation well for measurement, collection and utilization according to a gas and water production condition of hydrate decomposition and a pressure change condition in the natural gas hydrate reservoir, and the first check valve at the bottom of the outer string and the second check valve at the bottom of the production tubular string are opened at proper time to regulate and control the liquid-phase water above the safe water level in the exploitation well step by step and discharge the liquid-phase water under a condition of satisfying safe and effective depressurized production, to form an downhole gas-liquid synergic depressurized exploitation operation among the natural gas hydrate reservoir, the exploitation well, the water storage chamber and the annular region in the production tubular string.

15. The method according to claim 13, wherein, in said step 3, the discharged produced gas is measured by a gas flow detector, and then enters a gas storage, or is stored through liquification, wherein a part of the gas enters the water storage chamber through the gas supply pipeline and the flow controller for pressurization and water discharge when there is a pressure compensation requirement for the water storage chamber; and the produced water discharged from the water storage chamber passes the gas-water separation device, wherein a first part of the water enters the water outlet pipeline for collection, and a second part of the water enters the water return pipeline, and is then heated by the heating device and returned to the water storage chamber.

* * * * *